US005535446A

United States Patent [19]

Pusic

[11] Patent Number: 5,535,446

[45] Date of Patent: Jul. 16, 1996

[54] MOTORCYCLIST'S AIR STRIPS II

[76] Inventor: Pavo Pusic, 463 First St. Unit 6C, Hoboken, N.J. 07030

[21] Appl. No.: 251,405

[22] Filed: May 31, 1994

[51] Int. Cl.[6] ..... A41D 13/00

[52] U.S. Cl. ..... 2/2; 2/DIG. 3; 280/733

[58] Field of Search ..... 2/2, DIG. 3, 69; 280/733

[56] References Cited

U.S. PATENT DOCUMENTS 5,091,992 3/1992 Pusic ..... 2/2
5,153,938 10/1992 Epperson ..... 2/2.14
5,362,098 11/1994 Guill ..... 280/733

FOREIGN PATENT DOCUMENTS 2499373 8/1982 France ..... 2/DIG. 3

*Primary Examiner*—Diana Biefeld
*Attorney, Agent, or Firm*—Marks & Murase

[57] ABSTRACT

Inflatable air strips for protection of a motorcyclist body in case of a traffic accident are disclosed. The air strips comprise plurality of horizontal and vertical air strips which are all interconnected and inflated with gas from two gas inflators. A gas diffusing process is initiated by an activating cord which is extended from the ignitor unit and attached to the motorcycle.

11 Claims, 5 Drawing Sheets

MOTORCYCLIST'S AIR STRIPS II

BACKGROUND OF THE INVENTION

Every motorcyclist is exposed to a significant danger because existing protection gear cannot protect him/her from an injury in case of any serious accident. A certain protection in minor accidents, is ensured by boots, gloves and leather clothing but, due to numerous reasons, they are not consistently worn by a vast majority of motorcycle riders.

Satisfactory protection is provided by helmets which, unfortunately, can protect only against head injuries. Other body parts have virtually no sufficient protection and usually suffer great damage during a stronger collision. Motorcyclist crashes are well-known as being the most deadly and crippling type of traffic accident and represent a huge cost both to injured motorcyclists and society which has to care for victims.

Therefore, it is an object of the present invention to provide a device which will enable the best possible protection for motorcycle riders and significantly decrease the number of deaths and injuries in the case of accidents. It is yet another object of the present invention to provide a cost-effective, relatively comfortable, and easily stowable protection which will not significantly influence the rider's comfortability.

The present invention is intended to improve the invention entitled "Motorcyclist's Air Strips", U.S. Pat. No. 5,091,992 granted to the same author. The invention patented in said patent has been developed and tested, and it was found to have that some serious drawbacks which cannot be eliminated without changing certain elements of its design. The present invention is intended to eliminate the drawbacks of the patented design and provide an invention which will satisfy all requirements regarding both safety and convenience.

SUMMARY OF THE INVENTION

The major problem regarding the implementation of the invention presented in U.S. Pat. No. 5,091,992 is to design an inflator unit which will provide a satisfactory level of safety while not being unacceptably large and heavy. These two elements are considered important because they greatly influence the motorcyclist's comfortability and, consequently, a desire to use the device. It has been found that the inflator unit will have to be machined from a material which cannot allow an acceptable weight, if all requirements for safety and heat dissipation are to be satisfied. On the other hand, any other solution cannot guarantee that all safety requirements are satisfied to the extent which meets a reasonable level of safety in any predictable situation. Also, in order to make the invention more convenient to put on and take off, the design of the air strips has been slightly altered with respect to the previous proposal.

Tests performed during the research have shown that all requirements will be best satisfied if the inflator unit is filled with compressed gas (such as argon) and if more than one inflator unit is provided. Therefore, it is the proposal of the present invention to provide at least two inflator units, both filled with compressed gas and located at two different positions. The amount of gas compressed inside both inflators equals the amount of gas required to inflate the strips to a certain predetermined pressure. The unit containing a major portion of the compressed gas, hereinafter referred to as "main inflator", is preferably located around the edge of the motorcycle helmet and within the air strip which extends around the neck. Preferably, this unit is made of a tube which creates an irregular circle or two tubes connected on their front and rear edges creating an irregular circle which fits to the bottom edge of the helmet. The section located to the rear of the helmet will also have a one-way valve through which the gas is supplied inside the unit under a certain predetermined pressure. It will also have a gas outlet through which the gas will be let out of the inflator and inside the strip which surrounds it. The section located to the front of the helmet will have only the gas outlet. The gas compressed inside the main inflator is released through both gas outlets into the strips in a manner which will diffuse the gas both into the strip which extends around the neck and the strips which are extending vertically towards the back and front torso.

The main inflator is under a remarkably high pressure and it should be made of a material which will not enable an explosion under any conditions. Therefore, it is preferred that this unit is made of a high pressure air hose which is reasonably resistant to any kind of shock, such as impact with some other object during the time when the helmet is carried around. Also, since the main inflator is shaped as an irregular circle, the pressure of the gas inside this inflator acts in a manner which tends to push the opposite sides of the inflator away from each other. This outward pushing force would, in case of some rupture, force the unit's sections away from the motorcyclist's neck or body. It is assumed that this inflator can be securely fastened to the helmet in order to provide additional safety.

Since the main inflator cannot provide enough gas to fill the entire volume of the air strips, it is proposed that at least one additional inflator, hereinafter referred to as "second inflator" is provided inside the lower section of the strips. This unit can have a much smaller volume since the additional portion of the gas does not need to be so significant. The second inflator also has a one-way valve and one gas outlet. Preferably, this unit is also made of an air hose which will have a one-way valve on one side and one gas outlet on the other side. It will also be enclosed inside the strips and fasten to them. Both inflators have one diffusion initiator inside their gas outlets in order to electrically initiate the gas diffusion into the strips. The initiators have a certain small portion of propellant which, when ignited by an ignitor, explodes and breaks the inflator's wall which enables the gas to diffuse into the strips.

The ignitors which are placed into the propellant are connected to a battery which provides electricity required for ignition. The activating unit is provided with the battery and connected to the cord which is connected to the activator and attached to the motorcycle. When the cord is pulled to a certain predetermined distance, it causes the activator to establish an electric contact which enables an electric current to flow into the ignitors and cause the ignition of the propellant. A subsequent propellant combustion increases the pressure next to the gas outlet and causes the inflator unit's wall to brake. When the inflator wall brakes, it creates a hole through which the compressed gas streams out into the air strips and inflates their entire length. Since a rapid inert gas diffusion always causes the effect of undercooling, the heat developed by the propellant combustion will be offset by the low temperature of the expanding gas.

The air strips are made of very resistant fabric which can sustain considerable pressure and are designed to cover a significant portion of the body when inflated to their potential. Since their inflation has to be very rapid, it is proposed that the main inflator supplies the gas for the upper section of the strips and the second inflator supplies the gas to the lower section of the strips.

It is also the proposal of the present invention to provide the air strips which will be made of reflective material which will make the motorcyclist more visible to other participants in the traffic. Since the motorcycles are less visible on the road than any other vehicle, this will increase the safety of the riders.

All features and advantages of the present invention will become apparent from the following brief description of the drawings and the description of the preferred embodiment.

DETAILED DESCRIPTION OF THE PREFERRED EMBODIMENT

The present invention comprises inflatable air strips and two inflators 1 and 7 filled with pressurized gas, wherein both inflators contain one one-way gas supply valve and two gas outlet units. The air strips comprise vertical and horizontal strips which are all either sewn, vulcanized or fabricated together in a manner which allows the flow of gas through their entire length and enables them to form air tubes when inflated with the gas. The strips are made of a fabric (or some other suitable material) which is reasonably air-tight. The fabric has to be resistant enough to sustain the pressure caused by an impact of the motorcyclist's body against a pavement or some other object that the motorcyclist may hit during a fall.

Figure 1:
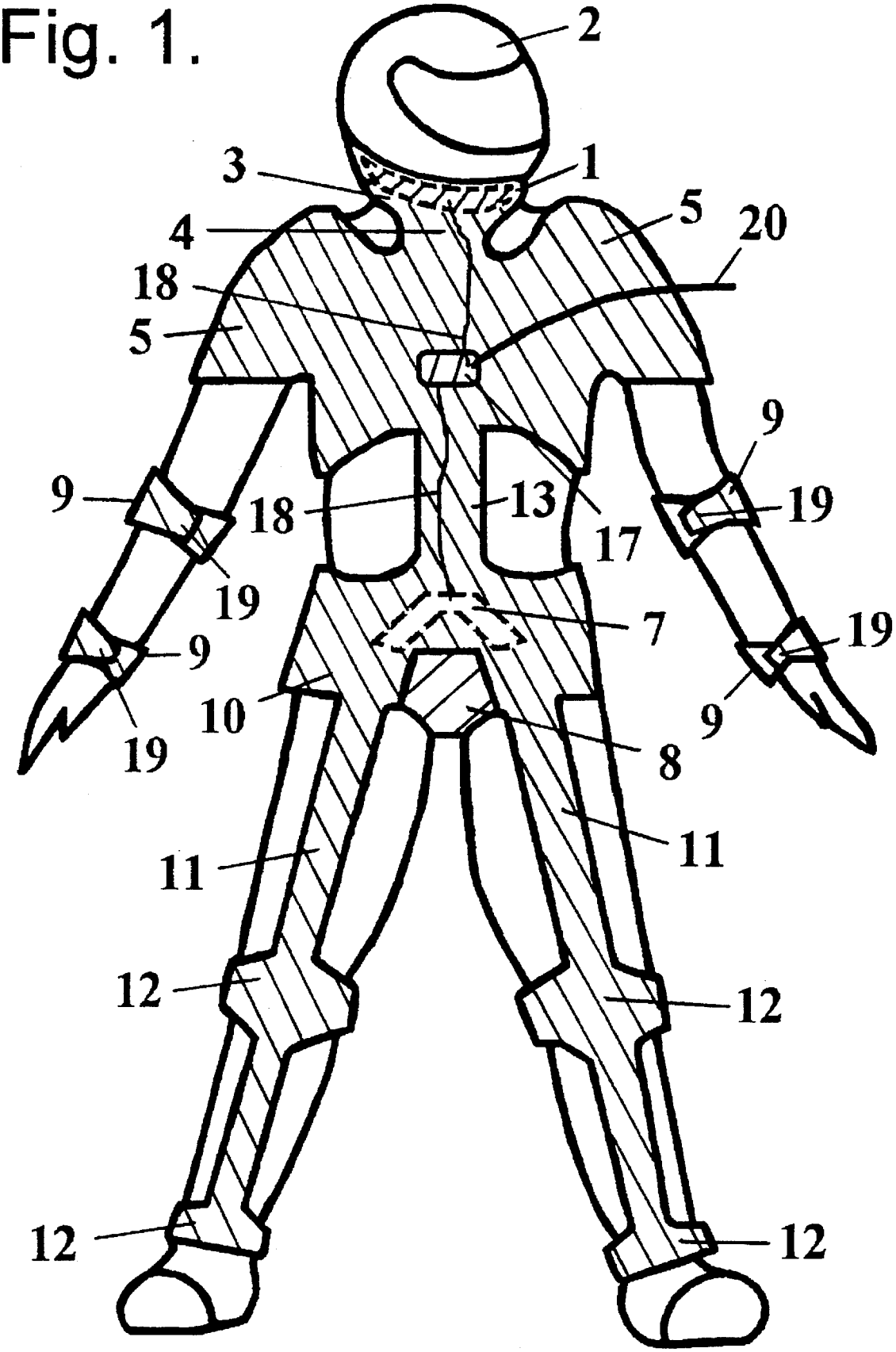
FIG. 1 is the front side view of the motorcyclist's body showing the arrangement of the uninflated air strips.
Figure 2:
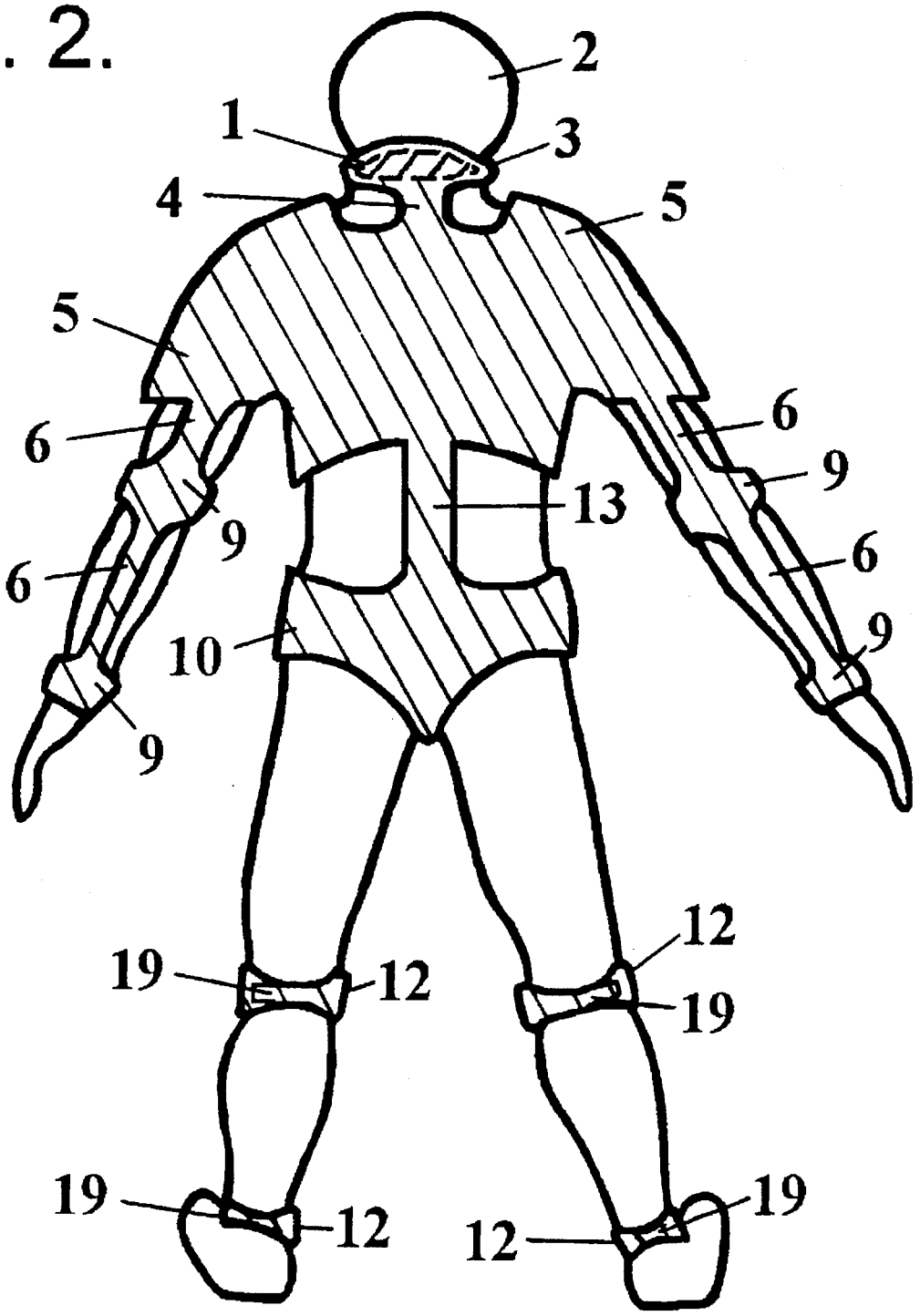
FIG. 2 is the rear side view of the motorcyclist's body showing the arrangement of the uniflated air strips.
Figure 5:
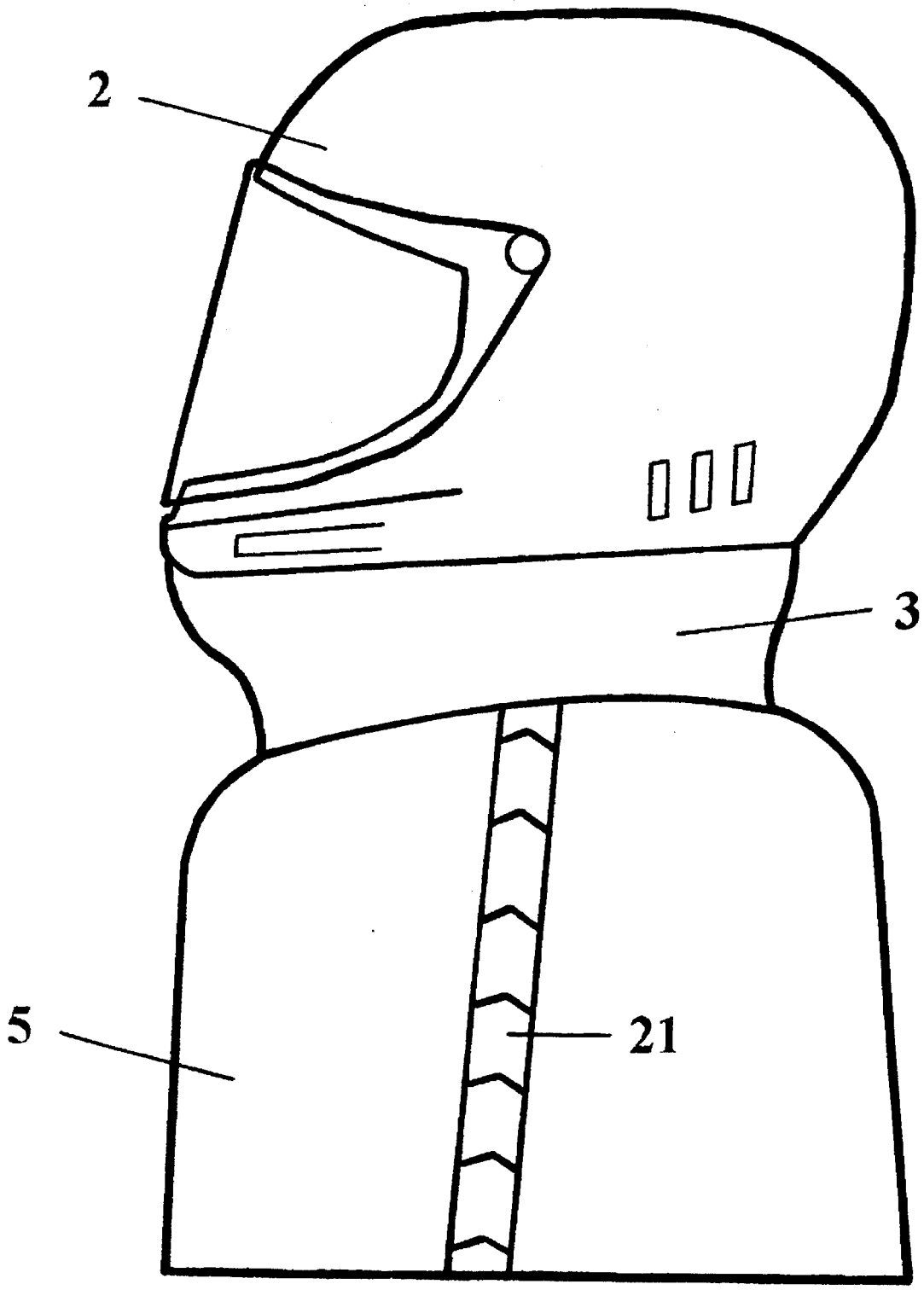
FIG. 5 is the side view of the upper section of the strips showing the zipper provided along the shoulder.

As shown in FIGS. 1 and 2, when uninflated, the strips are worn all around the motorcycle rider's body over clothing. One horizontal strip 3 extends around the motorcyclist's neck and houses the main inflator 1. Preferably, this strip 3 is firmly connected to the helmet but it can also be worn while disconnected from the helmet. When inflated, the strip 3 is intended to protect the molorcyclist's neck and, also, stabilize the head and prevent its rapid movement, either towards front or back, or towards left and right. Two vertical strips 4, also shown in FIGS. 1 and 2, extend from the horizontal strip 3 to the horizontal section 5 which covers the motorcyclist's shoulders and both sides of a torso. As shown in FIG. 5 the horizontal section 5 has two zippers 21 provided along its section which extends from the top of this section 5 and along both shoulders in order to simplify wearing and taking off the strips. The vertical strips 4 serve as a gas communication between the horizontal strips 3 and 5 and are intended to protect the back and front of the neck which is below the strip 3.

As shown in FIG. 2, two vertical strips 6 extend from the horizontal section 5 along both arms. Both vertical strips 6 are connected to four horizontal strips 9 which surround the motorcyclist's elbows and wrists on both arms, as also shown in FIG. 2. In order to simplify putting it on and off, the horizontal 9 are provided with VELCRO nylon fabric fastening 19 at their outer edges. These VELCRO nylon fabric fastener 19 are stuck together when the strips are worn and detached when the strips are taken off. Since the VELCRO nylon fabric fastener 19 can sustain relatively very high forces if such forces act in a horizontal manner (two forces acting in opposite directions horizontally), it is assumed beneficial with respect to the comfortability to provide this way of locking the strips 19 together. The above is also valid for the case of the horizontal strips 12 which extend around knees and ankles and their VELCRO nylon fabric fastening 19.

Two vertical strips 13, shown in FIGS. 1 and 2, extend from the horizontal section 5 to the horizontal section 10 and provide open communication between these two portions of the strips. One of the strips 13 extends along the spine and one extends along the stomach. When inflated, they 13 are intended to protect the spine and the stomach. The strip 10, shown in FIGS. 1 and 2, is made to surround the hips, the stomach and the lower back. It has two open communications 13 towards the section 5 and two open communications with the vertical ships 11 which extend along both legs as shown in FIG. 1. The strip 10 houses the second inflator 7 inside its front section as shown in FIG. 1. The second inflator 7 is attached to this strip 10 so that it is held together either when in an extended or stowed position.

One vertical strip 8 is provided from the rear section of the strip 10 to the front section of this strip 10. This strip 8 is made as an integral part of the rear section of the strip 10 or firmly attached to it. Front section of this strip 8 is attached to the front section of the strip 10 by VELCRO nylon fabric fastening as shown in FIG. 1. This design is proposed to enable a convenient putting on and off of the entire device. The vertical strips 11 extend along both legs as shown in FIG. 1. Their upper sections are attached to the horizontal strip 10 and their lower sections are attached to the lower horizontal strips 12 which surround the motorcyclist's ankles. The upper horizontal strips 12 surround the motorcyclist's knees and they are also attached to the vertical strips 11 as shown in FIG. 1. All vertical strips 12 are provided with VELCRO nylon fabric fastening on their ends as shown in FIG. 2.

Figure 3:
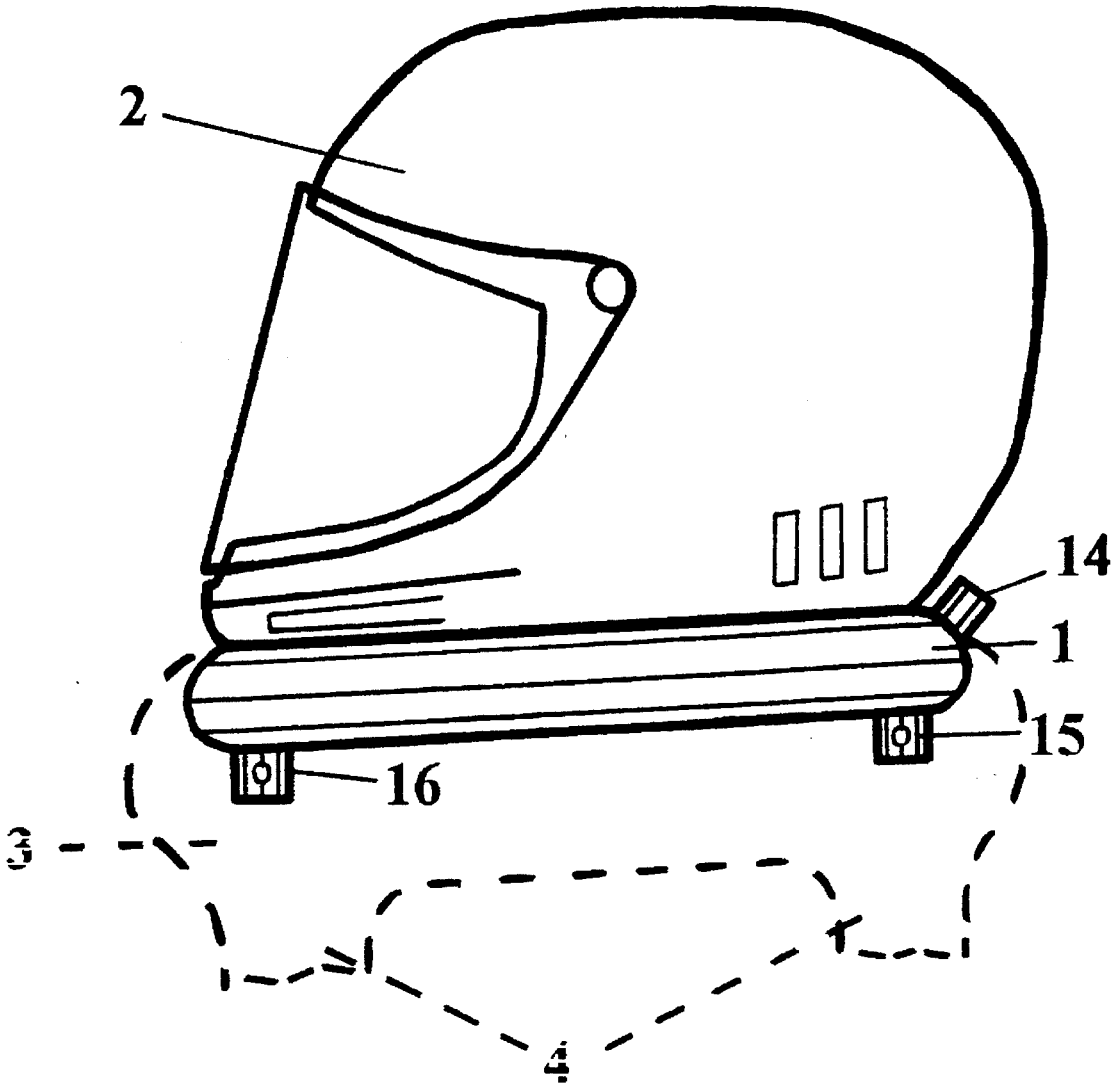
FIG. 3 is the side view of the main inflator attached to the helmet and enclosed inside the air strip which extends around the motorcyclist's neck.
Figure 4:
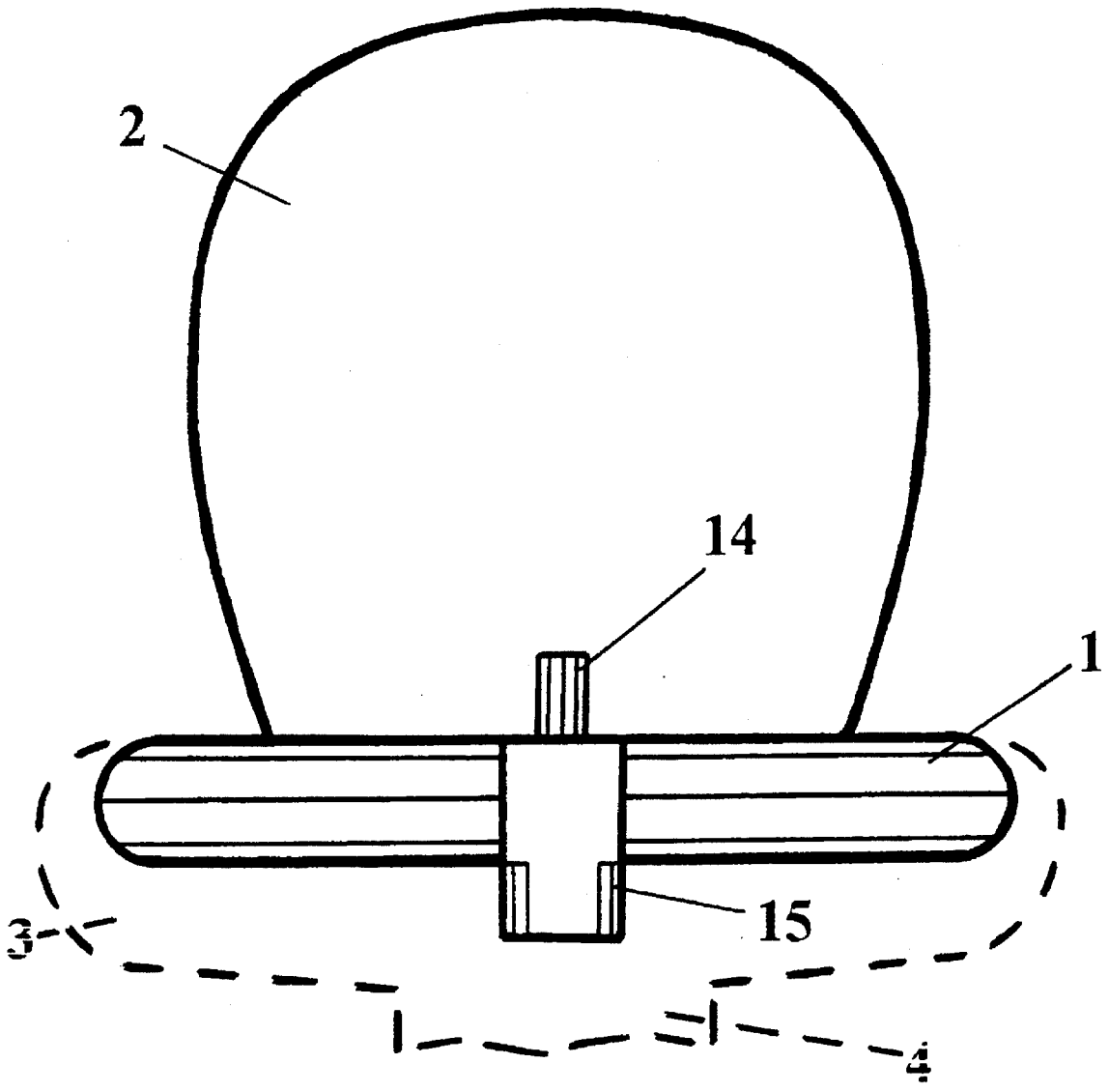
FIG. 4 is the back view of the main inflator attached to the helmet and enclosed inside the air strip which extends around the motorcyclist's neck.

The main inflator unit 1 is preferably located inside the horizontal strip 3 as shown in FIGS. 1, 2, 3, and 4. This inflator 1 is preferably made as a slightly irregular circle which fits the bottom edge of the helmet 2. As shown in FIGS. 3 and 4, the inflator 1 has one one-way valve 14 which enables the gas, such as argon, to be pumped and compressed inside the inflator 1. This valve 14 can also have a device which always indicates the pressure inside the inflator 1, so that the user can see if the pressure is decreased below a required level. Two gas outlets 15 and 16 are provided in the bottom side of the inflator 1 and located in line with two vertical strips 4. Their larger openings are provided on their bottom sides so as to direct a major portion of the released gas into the section 5 of the strips. The gas outlets also have smaller openings which are positioned horizontally so as to direct a minor portion of the released gas into the horizontal strip 3.

The gas outlets 15 and 16 have a very small portion of propellant stored inside their lower openings. One squib (not shown in FIGS.) is inserted into each portion of the propellant and connected by the electric cable 18 to the ignitor unit 17 which is provided in the strip 5 as shown in FIG. 1. The ignitor unit 17 is attached to the strip 5 and has one activating cord 20 extending out of the strips. One end of the cord 20 is inserted into the ignitor unit 17 and the other end is made to be attached to the motorcycle when the motorcyclist mounts the motorcycle. The electric cable provides an electric current which ignites the propellant when the cord 18 is extended over a certain predetermined distance.

The second inflator 7, shown in FIG. 1, is enclosed within the strip 10 and attached to it as shown in FIG. 1. This inflator 7 also has one one-way valve for supply of compressed gas and two gas outlets for discharge of the gas. The one-way valve and the gas outlets correspond to those which are provided inside the main inflator 1 and described above. The gas outlets are located at the ends of the inflator 1 and the one-way valve is located in the middle of the inflator 1. The gas outlets are positioned so as to enable a major portion of the released gas to flow inside the vertical strips 11 and enable their timely inflation. The inflator 7 is also connected to the ignitor unit 17 by the electric cable 18 which provides an electric current which ignites the propellant.

The ignitor unit 17, shown in FIG. 1, stores a battery and has a device which provides the electric contact upon the cord's 20 detachment. The process of the invention assumes that the motorcyclist attaches the cord 20 to the motorcycle as soon as he/she mounts the motorcycle. The cord 20 is made of material which does not expand under pressure and has a certain predetermined length. Since during almost every motorcycle crash the motorcyclist separates from the motorcycle, the cord 20 will be detached from the ignitor unit 17 and will activate the inflation process as described below.

It is assumed that the strips are stowed inside the helmet when not in use. When released from the stowed condition the air strips extend in their full length. The rider puts his legs through the section 10 and then puts his head through the horizontal strip section 5 and puts on the helmet 2. Then he/she attaches and closes the zippers 21 and VELCRO nylon fabric fastening strips 19 and 8. After mounting the motorcycle, he/she attaches the cord 20 to the motorcycle. This process is identical either for driver or rear seat passenger.

If the case of an accident, the motorcyclist separates from the motorcycle and the cord 20 which is firmly connected onto the motorcycle is pulled out from the ignitor unit 17. As the cord 20 is pulled out, the electric contact inside the ignitor unit 17 is established and the electric current flows through the cables 18 into the main inflator 1 and the second inflator 7. These electric currents ignite the propellants inside the gas outlets 15 and 16 in the main inflator and the gas outlets in the second inflator 7 (not shown in FIGS.). When ignited, the propellant produces small explosions which break the walls which separates the inside of the inflators 1 and 7 and their gas outlets. Since the gas inside the inflators 1 and 7 is compressed and have a very high pressure, the difference in pressure will cause this gas to be diffused through the gas outlets into the strips.

The propellant explosion will produce some gas which is also diffused into the strips. This gas has a high temperature but it will be momentarily offset by the low temperature of the diffused compressed gas from the inflators. A rapid expansion of the inert gas always produces an undercooling effect and this will instantly absorb the heat from the gas produced by the propellant explosion and prevent it from damaging the strips. The diffusion of the gas compressed inside the both inflators 1 and 7 have to be as rapid as possible so as to inflate the strips to a certain predetermined pressure before the motorcyclist collides with the pavement or some other object.

It is to be understood that the present invention has been described in relation to the particular embodiment herein chosen for the purpose of illustration and that the claims are intended to cover all changes and modifications, apparent to those skilled in the art, which do not constitute departure from the scope and spirit of the invention.

What is claimed is:

1. An easily stowable protective device to be worn over a cyclist's clothing during riding a cycle, the device being activated in the event of an accident to protect the cyclist, the protective device comprising:

at least one main source of pressurized gas including at least one fluid inlet and at least two fluid outlets, one of the fluid outlets including a rapidly burning propellant for causing an explosion, the main source of pressurized gas being designed as an irregular circle and having a form of a tube so as to encircle a cyclist's neck and to be easily attachable to a helmet;

at least one supporting source of pressurized gas being formed as a tube and having at least one fluid inlet and one fluid outlet, said supporting source being spatially separated from the main source of pressurized gas;

an ignitor unit for generating an electric current to initiate the explosion in the main source of pressurized gas and the supporting source of pressurized gas, the ignitor unit being connected on both said sources of pressurized gas;

an activator cord having first and second ends, the first cord end being attachable to a cycle and the second cord end being attachable to the ignitor unit whereby if a cyclist is thrown from a cycle the second cord end is detached from the ignitor unit so as to generate the electric current and ignite the propellant in both said sources of pressurized gas;

at least two electric current transmitting cables having first and second ends, the first ends being connected to the ignitor unit and the second ends being connected to both said sources of pressurized gas so as to transmit the electric current from the ignitor unit to the sources of pressurized gas;

a lateral neck protecting air strip encasing the main source of pressurized gas;

at least one longitudinal neck protecting air strip extending from the lateral neck protecting air strip, the longitudinal protecting air strip spaced next to one of the fluid outlets in the main source of pressurized gas;

a lateral torso protecting air strip having front and rear sections so as to encircle a torso and shoulders of a cyclist;

a horizontal hips protecting strip; and a plurality of additional protective air strips all of the protecting air strips being in unrestricted fluid communication with one another and the fluid outlets in the main and supporting sources of pressurized gas so as to provide pressurized gas to said air strips for inflating said air strips into air tubes for protecting a cyclist; the air strips being connected to one another so that they can be worn over cyclist's clothing and each air strip being substantially flattened in its uninflated state and inflatable into said air tube shape when pressurized gas is introduced into substantially fluid tight air passage and wherein a plurality of open spaces are provided between the air strips so that the air strips have a compact easily stowable design.

2. The protective device of claim 1, wherein the ignitor unit comprises source of electric power.

3. The protective device of claim 1, wherein all of the strips are joined together so as to allow the flow of gas through any section of the air strips.

4. The protective device of claim 1, wherein the main source of pressurized gas is located inside the lateral neck protecting strip and the supporting source of pressurized gas is located inside the lateral hips protecting strip.

5. The protective device of claim 1, wherein the lateral torso protecting air strip comprises attachment means so as to attach the front and the rear sections of said torso protecting air strip.

6. The protective device of claim 1, wherein the protective device has a compact construction so that the supporting source of pressurized gas, the ignitor unit, the electric current transmitting cables, the activator cord, and said protecting air strips can be stored in a small compartment such as a motorcycle helmet.

7. An easily stowable compact device which can be worn over the clothing of a cyclist while riding a cycle so as to protect the cyclist in the event of an accident, the protective device comprising:

a skeletal network of distinct interconnected air strips comprising a plurality of distinct air strips spaced so as to define empty spaces between the air strips so as to reduce the volume of the device such that the network of the air strips can be worn over a cyclist's clothing and stowed in a small area such as a cyclist's helmet when not in use, the air strips including an air strip adapted to encircle a cyclist's neck, an air strip adapted to encircle a torso and shoulders of a cyclist, an air strip adapted to encircle a lower stomach, hips, and a lower back of a cyclist, a plurality of distinct air strips adapted to encircle a cyclist's legs, a plurality of distinct air strips adapted to encircle a cyclist's arms, a plurality of distinct air strips adapted to protect a cyclist's spine and stomach, all said strips being in unrestricted fluid communication with one another;

one main source of pressurized gas and one supporting source of pressurized gas for storing pressurized gas, both said sources of pressurized gas having means for releasing pressurized gas into the skeletal network of air strips so as to inflate the network of the air strips into air tubes so as to protect a cyclist;

one ignitor unit connected to both said sources of pressurized gas for causing an explosion in both sources of pressurized gas and initiating a simultaneous diffusion of pressurized gas from both said sources of pressurized gas;

an activating cord extending from the ignitor unit and being attachable to a cycle, said activating cord being displaced from the ignitor unit so as to initiate an electric current to be transmitted to both sources of pressurized gas.

8. The device of claim 7, wherein the explosion in both said sources of pressurized gas is caused by igniting a propellant through establishing an electric current provided from the ignitor unit.

9. The device of claim 7, wherein the explosion in both said sources of pressurized gas creates an open communication between said sources of pressurized gas and the skeletal network of interconnected air strips so as to enable said simultaneous diffusion of pressurized gas.

10. An easily stowable protective device for protecting a cyclist in the event of an accident, the protective device comprising:

an interconnected network of inflatable air strips in fluid communication with one another, the network adapted to be easily stowable and worn over a cyclist's clothing and to encircle a cyclist's neck, torso, shoulders, arms, spine, lower stomach, lower back, and legs;

at least two spatially separated sources of pressurized gas, both said sources of pressurized gas including at least one fluid inlet and one fluid outlet and being connected to said network of inflatable air strips;

one ignitor unit comprising a source of electric power and being connected to both said sources of pressurized gas so as to initiate an explosion and provide at least two open communications between the sources of pressurized gas and the network of inflatable air strips;

one activator cord connected to the ignitor unit for activating an electric current when said activator cord is separated from said ignitor unit.

11. The protective device of claim 10, wherein the sources of pressurized gas are enclosed inside the network of inflatable air strips so as to provide a substantially even diffusion of pressurized gas to every section of said interconnected network of inflatable air strips.

* * * * *